United States Patent [19]

Kikuchi et al.

[11] 4,083,560

[45] Apr. 11, 1978

[54] TARGET ARRANGEMENT FOR A LIGHT PULSE BEAM COMPRISING CROSSWISE ARRANGED AND GROUPED PHOTOTRANSISTORS

[75] Inventors: Takayuki Kikuchi, Chigasaki; Fumiharu Yamada, Yamato; Satoshi Nakamura, Yokohama; Fumio Koyama, Kawasaki, all of Japan

[73] Assignee: Nishi Nippon Denki Co., Ltd., Osaka, Japan

[21] Appl. No.: 708,774

[22] Filed: Jul. 26, 1976

[51] Int. Cl.[2] ..... A63B 63/00

[52] U.S. Cl. ..... 273/102.2 B; 35/25; 250/209; 273/101.1

[58] Field of Search ..... 273/101, 102.2 B, 101.1; 250/208, 209, 203; 35/25

[56] References Cited

U.S. PATENT DOCUMENTS

| | | | |
|---|---|---|---|
| 3,205,363 | 9/1965 | Heetman | 250/208 |
| 3,549,147 | 12/1970 | Katter | 273/101.1 |

*Primary Examiner*—Rudolph V. Rolinec
*Assistant Examiner*—Michael J. Tokar
*Attorney, Agent, or Firm*—Sughrue, Rothwell, Mion, Zinn and Macpeak

[57] ABSTRACT

A target unit comprises equally spaced and crosswise arranged photoelectric converters responsive to a visible or invisible light pulse beam hitting the unit at an area including a center point for producing output pulses. The converters are disposed on four sides of the cross point, and divided into four adjacent groups, adjacent to the cross point and four remote groups, remote therefrom. The area is capable of covering the adjacent group converters but no more of the remote group ones when the center point coincides with the cross point. Counts of the output pulses for each adjacent group and for the associated remote group are added. The sum for the adjacent and remote group pair is subtracted from the sum for the related pair to drive an indicator for simulating the distance and the azimuth of the center point relative to the cross point.

5 Claims, 9 Drawing Figures

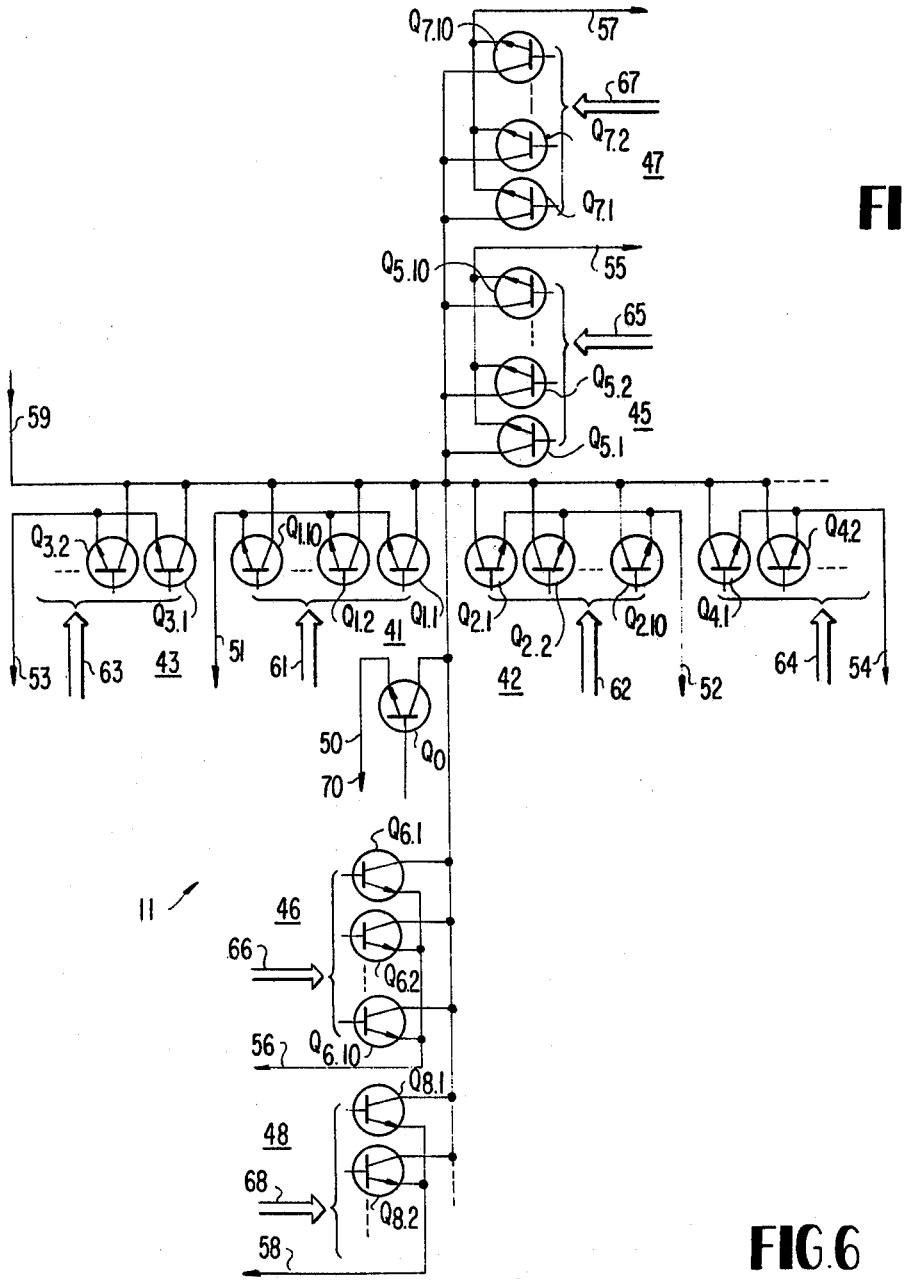
FIG.4
FIG.6
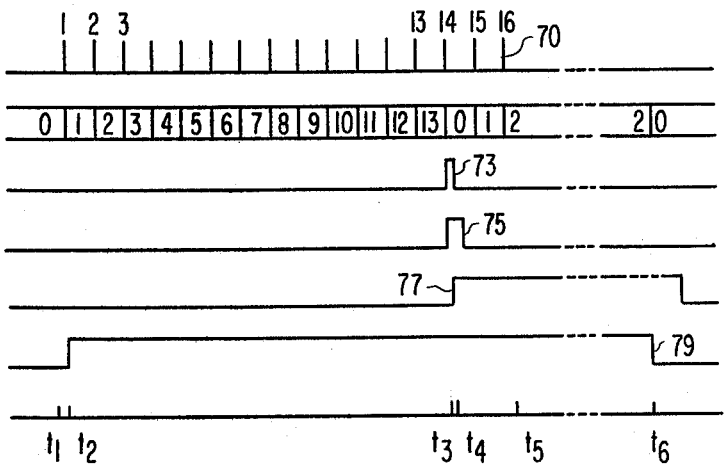

TARGET ARRANGEMENT FOR A LIGHT PULSE BEAM COMPRISING CROSSWISE ARRANGED AND GROUPED PHOTOTRANSISTORS

BACKGROUND OF THE INVENTION

This invention relates to a target arrangement responsive to a visible or invisible light pulse beam for simulating the position at which the beam hits a target.

Target arrangements of the type specified are for use in marksmanship training and/or contests, in recreation, such as darts or the like, in testing firearms, such as rifles, and in other various fields. A conventional target arrangement of the type described, such as disclosed in U.S. Pat. application Ser. No. 518,801, filed Oct. 29, 1974, by Takayuki Kikuchi et al, assignors to the present assignee (German Patent Application No. P 24 51 690), is operable in an analog fashion. Although the arrangement operates precisely and acculately, one operable in a digital manner is more preferable in view of the S/N ratio and for use, when desired, together with an electronic digital computer.

SUMMARY OF THE INVENTION

It is therefore an object of the present invention to provide a target arrangement operable on a digital basis.

It is a subordinate object of this invention to provide a target arrangement capable of acculately and precisely simulating a spot at which the center of a visible or invisible light beam consisting of a plurality of light pulses hits the target.

A target arrangement generally comprises a driver unit for controllably producing energizing signals and a target unit that has a predetermined point, such as the center of a mark, that is responsive to the energizing signals and to a light beam. The light beam consists a predetermined number of light pulses and hits the target unit at a cross-sectional area including a center point and approximately first and second predetermined radii in the respective directions of an X and a Y axis orthogonally or obliquely intersecting each other substantially at the predetermined point. The target unit produces output signals representative of the position, such as the distance and azimuthal angle, of the center point relative to the predetermined point. When the cross-sectional area is substantially circular as is often the case, the first and second radii are equal to each other. The arrangement further comprises a simulator unit responsive to the output signals for producing position signals representative of the above-mentioned position. In order to detect the light beam, the target unit comprises a plurality of photoelectric conversion elements energized by the energizing signals to be sensitive or responsive to the light pulses and thereby to produce output pulses as the afore-mentioned output signals.

In accordance with this invention, the photoelectric conversion elements of the above-described target unit are arranged substantially along the X and Y axes. Those disposed along the X axis are spaced from one another and from the predetermined point substantially with a first predetermined spacing and grouped into a first, a second, a third, and a fourth group. Likewise, those disposed along the Y axis are spaced from one another and from the predetermined point substantially with a second predetermined spacing and grouped into a fifth, a sixth, a seventh, and an eighth group. The photoelectric conversion elements of the first and second groups are disposed on different sides of and adjacent to the predetermined point. Those of the third and fourth groups are disposed on different sides of the photoelectric conversion elements of the first and second groups with respect to the predetermined point, respectively. Similarly, the photoelectric conversion elements of the fifth and sixth groups are disposed on different sides of and adjacent to the predetermined point. Those of the seventh and eighth groups are disposed on different sides of the photoelectric conversion elements of the fifth and sixth groups with respect to the predetermined point, respectively. Each of the first and second groups consists of a first predetermined number of the photoelectric conversion elements. Each of the fifth and sixth groups consists of a second predetermined number of the photoelectric conversion elements. The first and second predetermined spacings may be equal to each other. Furthermore, the first and second predetermined numbers may be equal to each other. In any event, the first predetermined spacing multiplied by the first predetermined number and that multiplied by a sum of the first predetermined number plus one are less and greater, respectively, than the first predetermined radius. In a like manner, the second predetermined spacing multiplied by the second predetermined number and that multiplied by another sum of the second predetermined number plus one are less and greater, respectively, than the second predetermined radius.

BRIEF DESCRIPTION OF THE DRAWING

FIG. 4 is a schematic front view of a target unit of the arrangement shown in FIG. 1;

FIG. 6 illustrates pulses used in the simulator unit portion shown in FIG. 5;

DESCRIPTION OF THE PREFERRED EMBODIMENTS

Figure 1:
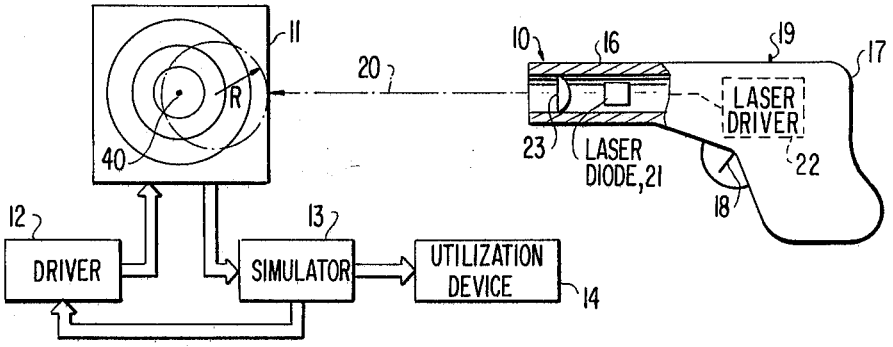
FIG. 1 shows a block diagram of a target arrangement according to an embodiment of the present invention together with a schematic partially cut away side view of a laser gun for use in combination with the target arrangement.

Referring to FIG. 1, a light beam target arrangement according to an embodiment of the present invention is for use with a light beam gun 10 and comprises a target unit 11, a driver unit 12, a simulator unit 13, and a utilization device 14. The light beam gun 10 exemplified herein is quite similar in appearance to an ordinary rifle, pistol, or revolver and is equipped with a barrel 16, a stock 17, a trigger 18, a sight 19, and standard features. In order to make the gun 10 produce a visible or invisible light beam 20 consisting of light or optical pulses, the gun 10 comprises in the barrel 16 a solid-state or semiconductor laser 21, herein called a laser diode, and a laser driving circuit 22 in the stock 17. Each time the trigger 18 is pulled, the laser driving circuit 22 makes the laser diode 21 produce a predetermined number of light pulses which are substantially collimated into the light beam 20 by an optical system 23 disposed in the barrel 16. Pulses are used in order to distinguish the light beam 20 incident on the target unit 11 from any other light, such as sunlight, that falls thereon.

Figure 2:
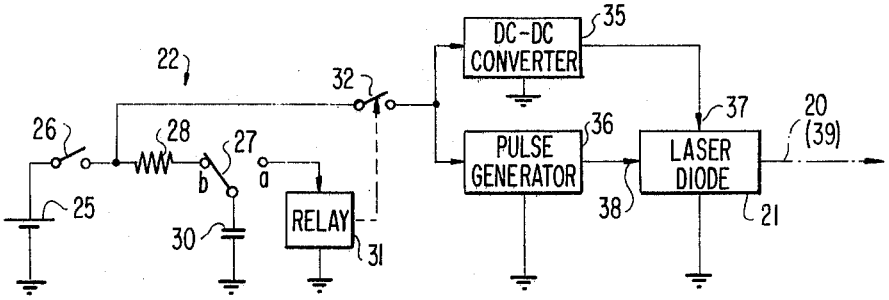
FIG. 2 is a block diagram of a laser driving circuit of the laser gun and a laser used in the laser gun.

Turning to FIG. 2, a laser driving circuit 22 for a light beam gun 10 comprises a self-contained power source 25, a power switch 26, and a transfer switch 27 having a make contact *a* and a break contact *b*, the latter being connected to the power source 25 through the power switch 26 and a resistor 28. The power source 25 may be a small-sized storage battery. The circuit further comprises a capacitor 30 connected to a movable arm of the transfer switch 27 and a relay 31 connected to the make contact *a*. The relay 31 has a relay make contact 32 connected to the power source 25 through the power switch 26. The circuit still further comprises a d.c.-to-d.c. converter 35 and a pulse generator 36, both between the relay make contact 32 and the laser diode 21. On putting the gun 10 into operation, the power switch 26 is closed. This renders the gun 10 ready for use, charging the capacitor 30. When the trigger 18 is pulled, the transfer switch 27 transfers its point of contact from the break contact *b* to the make contact *a* to discharge the capacitor 30 through the relay 31 and thereby to close the relay make contact 32 for a predetermined time interval that may be, for example, from 1 to 100 milliseconds.

Figure 3:
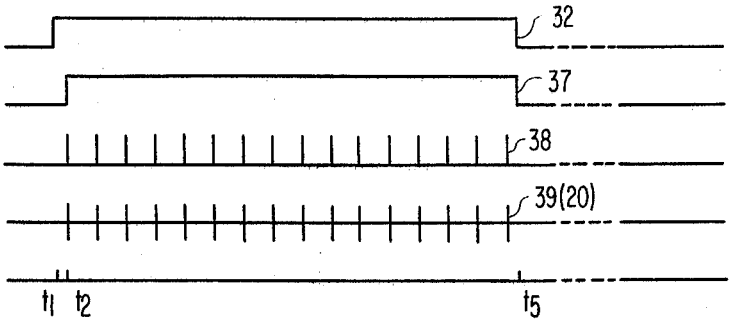
FIG. 3 illustrates pulses used in the laser driving circuit and of a light beam produced by the laser gun.

Referring to FIG. 3, let the trigger 18 be pulled at a first instant $t_1$. The relay make contact 32 is closed to make the d.c.-to-d.c. converter 35 and pulse generator 36 supply a high d.c. voltage 37 and an electric pulse sequence 38, respectively, across the laser diode 21 from a second instant $t_2$ on. The d.c. voltage 37 and pulse sequence 38 last as long as the relay make contact 32 remains closed for the predetermined time interval. In the example being illustrated, the pulse generator 36 produces sixteen pulses 38 within the interval. Supplied with the high d.c. voltage 37 and pulses 38, the laser diode 21 produces a corresponding number of light pulses 39 of the beam 20.

Referring again to FIG. 1 and also to FIG. 4, the target unit 11 comprises a detector and a covering transparent sheet. The sheet has a predetermined point 40 and may have a mark composed of a plurality of concentric circles having a common center at the predetermined point 40. It is assumed here for simplicity of description that the light beam 20 falls on the target 11 with an irradiated circular area of a radius R (FIG. 1) that may be about 8 cm. The detector comprises a plurality of photoelectric conversion elements which may be phototransistors Q (various suffixes being later added in order to differentiate one from another). The phototransistors Q are arranged substantially along coordinate axes X and Y (not shown) intersecting each other substantially at the predetermined point 40, with a center phototransistor $Q_0$ placed substantially at the predetermined point 40 and with others successively spaced therefrom with an equal spacing D (not shown). The phototransistors disposed along the X axis are divided into first, second, third, and fourth groups 41, 42, 43, and 44 while those disposed along the Y axis are divided into fifth, sixth, seventh, and eighth groups 45, 46, 47, and 48. The first, second, fifth, and sixth groups 41, 42, 45, and 46 are adjacent to and on different sides of the predetermined point 40. Each of these adjacent groups 41, 42, 45, and 46 consists of the phototransistors of a predetermined number which should not be greater than the predetermined pulse number and may be ten. The third, fouth, seventh, and eighth groups 43, 44, 47, and 48 are disposed remote from the predetermined point 40 on different sides of the adjacent groups 41, 42, 45, and 46. In the example being illustrated, each of these remote groups 43, 44, 47, and 48 also consists of ten phototransistors although the number for the remote groups 43, 44, 47, and 48 may be different from that for the adjacent groups 41, 42, 45, and 46 and is merely preferably less than or equal to the predetermined pulse number. The phototransistors in each of the first through eighth groups 41 through 48 are therefore countable from the predetermined point 40, as designated by $Q_{kn}$ ($n = 1, 2, \ldots,$ and 10) for the *k-th* group ($k = 1, 2, \ldots,$ and 8). The equal spacing D of the phototransistors Q is selected such that the radius R of the irradiated area may be longer than an end to end length of each adjacent group 41, 42, 45, or 46 and shorter than a length that is equal to the end to end length plus the equal spacing D, or more precisely:

$$ND < R < (N + 1)D,$$

where N represents the predetermined number of the phototransistors in each adjacent group 41, 42, 45, or 46. Although not shown, hoods, filters, and/or lens systems may be arranged in front of the phototransistors Q to reduce the ambient or background light incident thereon.

Figure 5:
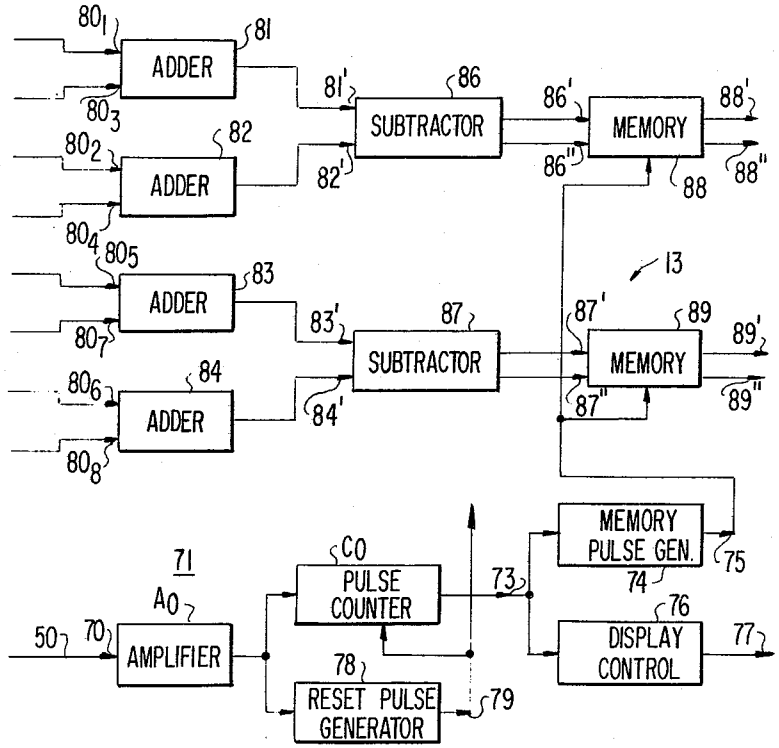
FIG. 5 is a block diagram of a portion of a simulator unit of the arrangement depicted in FIG. 1.
Figure 7:
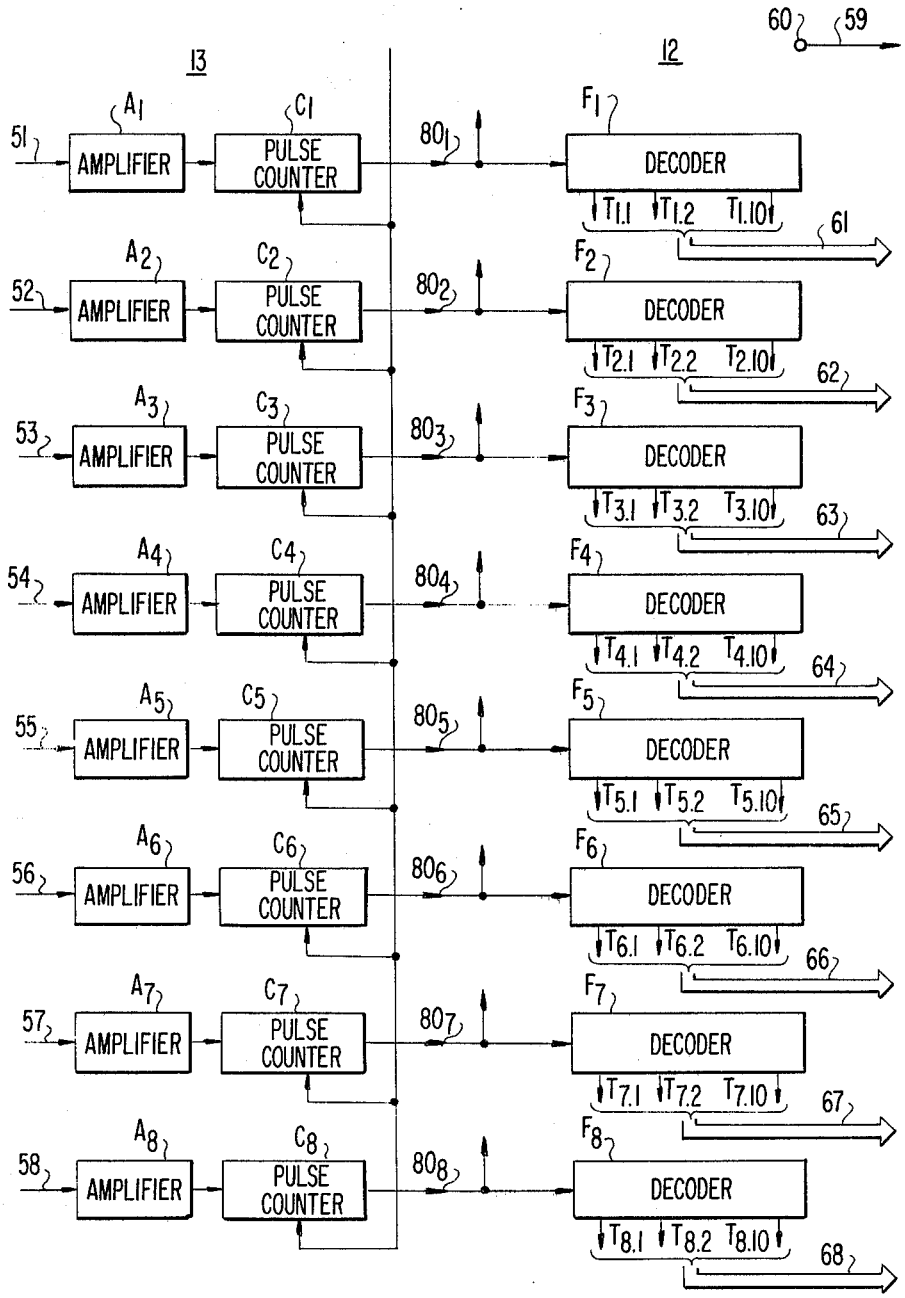
FIG. 7 is a block diagram of a driver unit of the arrangement shown in FIG. 1 and of the remaining portion of the simulator unit.

Referring further to FIG. 4 and also to FIGS. 5 through 7, the emitter electrode of the center phototransistor $Q_0$ is connected to a center pulse counter $C_0$ of the simulator unit 13 through a center output line 50 and an amplifier $A_0$. Emitter electrodes of the phototransistors of the first through eighth groups 41 through 48 are connected together by group and to first, second, third, fourth, fifth, sixth, seventh, and eighth pulse counters $C_k$ (FIG. 7) through output lines 51, 52, 53, 54, 55, 56, 57, and 58 and amplifiers $A_k$, respectively. Collector electrodes of all phototransistors Q are supplied with a collector voltage through a power supply line 59 from a power supply 60 which may be common to other circuit elements of the driver and simulator units 12 and 13. The base electrode of the center phototransistor $Q_0$ is open-circuited. Base electrodes of the phototransistors $Q_{kn}$ of the first through eighth groups 41 through 48 are supplied with decoder output signals from first, second, third, fourth, fifth, sixth, seventh, and eighth decoders $F_k$ of the driver unit 12 through input line groups 61, 62, 63, 64, 65, 66, 67, and 68, respectively. More specifically, each of the decoders $F_k$ has decoder output terminals $T_{kn}$ which are serially numbered from one to the predetermined number for the phototransistors $Q_{kn}$ and connected to the base electrodes of the phototransistors $Q_{kn}$, respectively, of the corresponding group.

Referring more in detail to FIGS. 5 and 6, it should be pointed out at first that the center phototransistor $Q_0$, supplied with the collector voltage as the energizing signal, is put into an operable state capable of delivering a pulse current 70 to the center pulse counter $C_0$ whenever irradiated by pulses of the light beam 20. Each of the other phototransistors $Q_{kn}$ delivers a pulse current to the relevant pulse counter $C_k$ only when exposed to pulses of the light beam 20 during the time that the base electrode thereof is supplied with the decoder output signal as the energizing signal. This raises the S/N ratio of the target arrangement according to this invention. The simulator unit 13 comprises a calculation control circuit 71 including, in turn, the center pulse counter $C_0$. The center counter $C_0$ has a complete counting cycle 72 of counting a predetermined count to produce a center counter output pulse 73 on completion of the counting cycle. The predetermined count should be less than or equal to the predetermined pulse number and greater than or equal to the predetermined number for the phototransistors of the adjacent groups 41, 42, 45, and 46. If the latter number is different for the first and second groups 41 and 42 and for the fifth and sixth groups 45 and 46, the predetermined count should be greater than or equal to the greater of the latter numbers. In the illustrated example, the predetermined count is fourteen (from zero sequentially to thirteen) with the result that the leading edge of the center counter output pulse 73 appears at a third instant $t_3$ when the sequentially increasing count 72 decreases from thirteen back to zero and that the trailing edge thereof appears at a fourth instant $t_4$ immediately following the third instant $t_3$. The calculation control circuit 71 further comprises a memory pulse generator 74 responsive to the center counter output pulse 73 for producing a memory pulse 75 of a short duration, such as about 40 microseconds, from the third instant $t_3$. The short duration is preferably shorter than the repetition period of the light pulses 39. The circuit 71 still further comprises a display control pulse generator 76 responsive also to the center counter output pulse 73 for producing a rectangular pulse 77 of a considerably long duration, such as from 4 to 6 seconds, from the fourth instant $t_4$. In the meantime, each of the high d.c. voltage 37 and laser exciting pulses 38 ends at a fifth instant $t_5$ (also shown in FIG. 3). The circuit 71 yet further comprises a reset pulse generator 78 responsive in effect to the pulse current 70 for producing a reset pulse 79 for the pulse counters $C_0$ and $C_k$ at a sixth instant $t_6$ a predetermined time after the fifth instant $t_5$. This predetermined time should be longer than the predetermined time interval between the first and fifth instants $t_1$ and $t_5$ and may be about 200 milliseconds from the second instant $t_2$. In the example depicted, the pulse 79 lasts from the second instant $t_2$ at which the count 72 increases for the first time from zero to one. In this event, the reset pulse in the usual sense is obtained by differentiating the pulse 79 and taking out the negative going pulse. Each of the circuit elements 74, 76, and 78 may be a monostable multivibrator or a combination of a monostable multivibrator and a bistable circuit.

Figure 8:
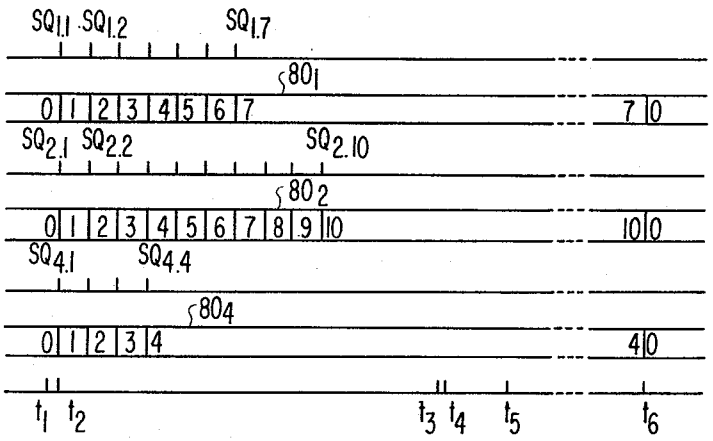
FIG. 8 illustrates pulses appearing in the circuitry depicted in FIG. 7.

Referring again to FIGS. 5 through 7 and also to FIG. 8, the pulse counters $C_k$ count the pulses of the pulse currents supplied through the respective output lines 51 through 58 and produce count signals $80_k$ representative of the counts sequentially increasing from zero in response to the number of pulses of the pulse currents supplied thereto. A first adder 81 is connected to the first and third pulse counters $C_1$ and $C_3$ to produce a first sum signal 81' representative of a sum of the counts represented by the count signals $80_1$ and $80_3$. Similarly, second, third, and fourth adders 82, 83, and 84 produce second, third, and fourth sum signals 82', 83', and 84'. Responsive to the first and second sum signals 81' and 82', a first subtractor 86 produces a first difference signal 86' and a first sign signal 86'' representative of the absolute value and the sign of a difference between the sums represented by the first and second sum signals 81' and 82'. Likewise, a second subtractor 87 produces a second difference signal 87' and a second sign signal 87'' representative of the absolute value and the sign of another difference between the sums represented by the third and fourth sum signals 83' and 84'. The first difference and sign signals 86' and 86'' are supplied to a first memory 88, stored therein in response to the memory pulse 75 in place of a previous content thereof, and produced therefrom as a first set of simulator output signals 88' and 88'' which are in fact the first difference and sign signals 86' and 86'' but lasting until a next subsequent memory pulse 75 is produced by the memory pulse generetor 74. In a like manner, a second memory 89 stores the second difference and sign signals 87' and 87'' and produces a second set of simulator output signals 89' and 89''. These first and second simulator output signals 88', 88'', 89', and 89'' are supplied to the utilization device 14.

Referring once more to FIGS. 6 and 7, the count signals $80_k$ are supplied from the first through eighth pulse counters $C_k$ to the first through eighth decoders $F_k$ to make the latter successively produce the decoder output signals from the decoder output terminals $T_{kn}$ having serial numbers $n$ equal to the sequentially increasing counts plus one, respectively. The decoder output signals are successively supplied to the phototransistors $Q_{kn}$ of the respective groups 41 through 48 in a time division fashion as the energizing signals therefor to make the phototransistors $Q_{kn}$ disposed within the irradiated area sequentially deliver the pulse currents to the output lines 51 through 58 in the time slots indicated by the decoder output signals.

In operation, it should be pointed out at first that the pulse counters $C_0$ and $C_k$ are all kept in their respective reset states of producing the center counter output pulse or signal 73 and count signals $80_k$ representative of zero before the trigger 18 is pulled and that the center phototransistor $Q_0$ is always in the operable state provided that the collector voltage is supplied thereto as the energizing signal therefor. When use is made of the pulse 79 of a shape depicted in FIG. 6, the pulse counters $C_0$ and $C_k$ are insured not to operate before a first pulse of the pulse current 70 is supplied from the center phototransistor $Q_0$ to the reset pulse generator 78. At any rate, only those phototransistors $Q_{kl}$ of the respective groups 41 through 48 which are nearest to the predetermined point 40 are in their respective operable states.

Let it now be assumed that the irradiated area covers seven phototransistors $Q_{1.1}$ through $Q_{1.7}$ of the first group 41. These phototransistors $Q_{1.1}$ through $Q_{1.7}$ successively produce pulse currents or pulses $SQ_{1.1}$, $SQ_{1.2}$, . . ., and $SQ_{1.7}$. The count signal $80_1$ produced by the first pulse counter $C_1$ represents numbers sequentially varying from 0 (before pulling the trigger 18) to 7. Under the circumstances, all phototransistors $Q_{2.1}$ through $Q_{2.10}$ of the second group 42 would be covered by the irradiated area to successively produce pulses $SQ_{2.1}$, $SQ_{2.2}$, . . ., and $SQ_{2.10}$. The count signal $80_2$ produced by the second pulse counter $C_2$ is sequentially representative of 1, 2, . . ., and 10. It may be that the irradiated area includes four phototransistors $Q_{4.1}$ through $Q_{4.4}$ of the fourth group 44. Successively produced pulses $SQ_{4.1}$, . . ., and $SQ_{4.4}$ render the count signal $80_4$ representative of a sequence of 1, 2, 3, and 4. Under the assumption, the first sum signal 81' represents seven. The second sum signal 82' represents fourteen. The first difference signal 86' therefore represents seven while the first sign signal 86'' is indicative of the plus sign. This means that the center of the irradiated area has an abscissa of about seven divided by two.

Let it be presumed that the X and Y axes intersect each other at right angles. As a first example, let the irradiated area have its center at a point (7D, 5D) to cover the phototransistors $Q_{2.1}$ through $Q_{2.10}$ and $Q_{4.1}$ through $Q_{4.6}$, $Q_{1.1}$ and $Q_{1.2}$, $Q_{5.1}$ through $Q_{5.10}$, $Q_{7.1}$, and $Q_{7.2}$, and $Q_{6.1}$ and $Q_{6.2}$. The first and second sum signals 81' and 82' represent sixteen and two, respectively. The third and fourth sum signals 83' and 84' represent twelve and two. The first difference and sign signals 86' and 86'' represent fourteen and the plus sign. The second difference and sign signals 87' and 87'' represent ten and plus. As a second example, let the irradiated area have its center at a point (−5D, 6D) to cover phototransistors $Q_{2.1}$ through $Q_{2.3}$, $Q_{1.1}$ through $Q_{3.3}$, $Q_{5.1}$ through $Q_{7.5}$, and $Q_{6.1}$ through $Q_{6.3}$. The first through fourth sum signals 81' through 84' represent three, thirteen, fifteen, and three, respectively. The first difference and sign signals 86' and 86'' are representative of ten and minus. The second difference and sign signals 87' and 87'' represent twelve and puls. As a third example, let the irradiated area have its center at a point (−9D, −2D) to cover phototransistors $Q_{2.1}$, $Q_{1.1}$ through $Q_{3.9}$, $Q_{5.1}$ through $Q_{5.3}$, and $Q_{6.1}$ through $Q_{6.7}$. The first through fourth sum signals 81' through 84' represent one, nineteen, three, and seven, respectively. The first difference and sign signals 86' and 86'' represent eighteen and minus. The second difference and sign signals 87' and 87'' represent four and minus. As a fourth example, let the irradiated area have its center at a point (2D, −6D) to cover phototransistors $Q_{2.1}$ through $Q_{2.10}$, $Q_{1.1}$ through $Q_{1.6}$, $Q_{5.1}$ through $Q_{5.4}$, and $Q_{6.1}$ through $Q_{8.6}$. The first through fourth sum signals 81' through 84' represent ten, six, four, and sixteen, respectively. The first difference and sign signals 86' and 86'' are representative of plus four. The second difference and sign signals 87' and 87'' are indicative of minus twelve. If the utilization device 14 is an electronic digital computer, the computer calculates in response to the rectangular pulse 77 the points scored by actuation of the trigger 18 a plurality of times to evaluate, for example, the ability of a marksman or exactness of the sight 19. With an electronic digital computer, it is readily possible to make use of the simulator output signals 88', 88'', 89', and 89'' even when the X and Y axes intersect each other at an oblique angle or when additional phototransistors (not shown) are arranged substantially along one or more rectilinear lines intersecting the X and Y axes substantially at the predetermined point 40 in order to raise the resolving power.

Figure 9:
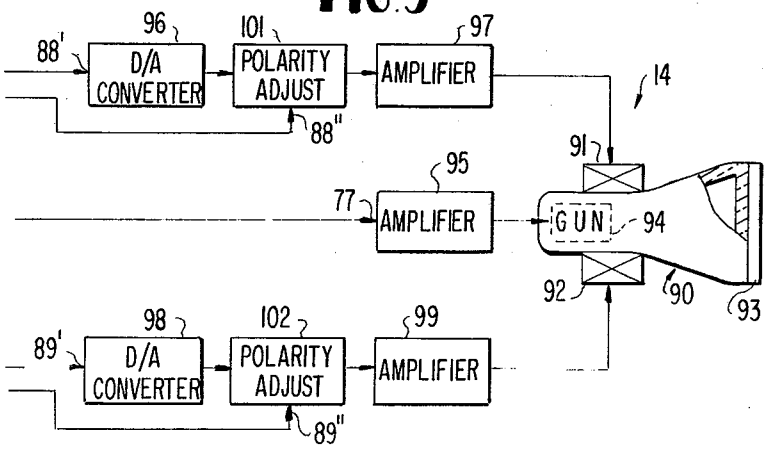
FIG. 9 is a block diagram of a utilization device of the arrangement illustrated in FIG. 1.

Referring finally to FIG. 9, the utilization device 14 may be a display device that comprises a cathode-ray tube 90 having X and Y deflection coils 91 and 92 around the neck portion. A transparent plate 93 having a mark corresponding to that of the target unit 11 may be placed in front of a fluorescent or viewing screen of the cathode-ray tube 90. It is possible to deem such a display device to be a portion of the simulator unit 13. In oder to make the cathode-ray tube 90 produce a spot on the viewing screen, the rectangular pulse 77 is supplied to an electron gun 94 of the cathode-ray tube 90 through an amplifier 95. The display unit 14 further comprises a first digital-to-analog converter 96 responsive to the first difference signal 88' for producing an X deflection current supplied to the X deflection coil 91 through an amplifier 97. Similarly, a second digital-to-analog converter 98 supplies a Y deflection current to the Y deflection coil 92 through another amplifier 99. When at least one of the sign signals 88'' and 89'' are inconsistent with the X and Y deflection of the cathode-ray tube 90, use should be made of polarity adjust units 101 and 102 to reverse or otherwise rectify the polarity of the deflection currents. It is possible to adjust the X and Y deflection by the amplifiers 97 and 99.

While this invention has thus far been described in conjunction with a preferred embodiment thereof and with various modifications, it should be understood that other embodiments and modifications are possible within the scope of this invention. For example, the display unit 14 may comprise an electrostatic deflection cathode-ray tube, an array of light-emitting diodes, a plasma display panel, and X-Y recorder, or any other two-dimensional display device. The computer may be that installed in a computer center and is accessible through a data line. Although a laser beam 20 is preferred, the target arrangement according to this invention is equally well operable with pulses of any other light beam. The laser diode 21 is preferably a gallium arsenide one that nominally emits a laser beam 20 of 9050 A. The power switch 26 may be dispensed with. Some or all of the amplifiers may also be dispensed with. The power and transfer switches 26 and 27 and the relay 31 with its make contact 32 may be electronic equivalents. The photoelectric conversion elements may be photodiodes or photocells provided that they are sensitive to the light beam 20 used. The photodiodes except the center one should, however, be supplied with the respective decoder output signals so as to cancel the backward bias normally applied thereacross. The predetermined pulse number is preferably from fifteen to twenty. The light beam gun 10 as called hereinabove need not be of a shape similar to a real firearm but may merely be a source of the light pulse beam 20 in case where the target arrangement is for recreation, particularly for use in combination with a target unit 11 that is a moving object. If the latter case, the power switch 26 may be a coin operable switch, with the utilization device 14 rendered capable of supplying a prize. The units as called herein need not be physically separate units. It is possible to dispose those photoelectric conversion elements of the first, second, fifth, and sixth groups 41, 42, 45, and 46 which are nearest to the predetermined point 40, at a distance from the predetermined point 40 somewhat different from the equal spacing D. The equal spacings D may also be somewhat different from one another.

What is claimed is:

1. In a target arrangement comprising a driver unit for controllably producing energizing signals, a target unit having a predetermined point and being responsive to said energizing signals and to a light beam consisting of a predetermined pulse number of light pulses of a predetermined repetition period and hitting said target unit at a cross-sectional area including a center point and approximately having a first and a second predetermined radius in the directions of an X and a Y axis intersecting each other substantially at said predetermined point, respectively, for producing output signals representative of a position of said center point relative to said predetermined point, and a simulator unit responsive to said output signals for indicating said position, said target unit comprising a plurality of photoelectric conversion elements responsive to said energizing signals and to said light pulses for producing output pulses as said output signals, the improvement wherein said photoelectric conversion elements are arranged substantially along said X and Y axes, the photoelectric conversion elements disposed along said X axis being spaced from one another and from said predetermined point substantially with a first predetermined spacing and grouped into a first, a second, a third, and a fourth group, the photoelectric conversion elements disposed along said Y axis being spaced from one another and from said predetermined point substantially with a second predetermined spacing and grouped into a fifth, a sixth, a seventh, and an eighth group, the photoelectric conversion elements of said first and second groups being disposed on different sides of and adjacent to said predetermined point, the photoelectric conversion elements of said third and fourth groups being disposed on different sides of the photoelectric conversion elements of said first and second groups with respect to said predetermined point, respectively, the photoelectric conversion elements of said fifth and sixth groups being disposed on different sides of and adjacent to said predetermined point, the photoelectric conversion elements of said seventh and eighth groups being disposed on different sides of the photoelectric conversion elements of said fifth and sixth groups with respect to said predetermined point, respectively, each of said first and second groups consisting of a first predetermined number of the photoelectric conversion elements, each of said fifth and sixth groups consisting of a second predetermined number of the photoelectric conversion elements, each of said first and second predetermined numbers being not greater than said predetermined pulse number, said first predetermined spacing multiplied by said first predetermined number being less than said first predetermined radius, said first predetermined spacing multiplied by a first sum of said first predetermined number plus one being greater than said first predetermined radius, said second predetermined spacing multiplied by said second predetermined number being less than said second predetermined radius, said second predetermined spacing multiplied by a second sum of said second predetermined number plus one being greater than said second predetermined radius.

2. A target arrangement as claimed in claim 1, wherein said simulator unit comprises a first, a second, a third, a fourth, a fifth, a sixth, a seventh, and an eighth pulse counter supplied with the output pulses from the photoelectric conversion elements of said first through eighth groups, respectively, for counting the supplied output pulses to produce count signals representative of the respective counts of the supplied output pulses, a first, a second, a third, and a fourth adder supplied with the count signals from said first and third, second and fourth, fifth and seventh, and sixth and eighth pulse counters, respectively, for calculating sums of the counts represented by the supplied count signals to produce sum signals representative of the respective sums, a first and a second subtractor supplied with the sum signals from said first and second adders and from said third and fourth adders, respectively, for calculating differences between the sums represented by the supplied sum signals to produce difference signals representative of the respective differences, an indicator responsive to first and second input signals for indicating said position, and first and second means for supplying the difference signals from said first and second subtractors to said indicator as said first and second input signals, respectively.

3. A target arrangement as claimed in claim 2, wherein said target unit further comprises a center photoelectric conversion element substantially at said predetermined point, said center photoelectric conversion element being responsive to said energizing signals and to said light pulses for producing center output pulses, wherein said simulator unit comprises a reset pulse generator responsive to said center output pulses for producing a rest pulse a predetermined time after the center output pulse is supplied thereto in response to the last one of said predetermined pulse number light pulses, and wherein said control unit comprises means for supplying said energizing signals to said center photoelectric conversion element, said target arrangement further comprising means for supplying said reset pulse to said first through eighth pulse counters.

4. A target arrangement as claimed in claim 3, wherein said control unit further comprises a first, a second, a third, a fourth, a fifth, a sixth, a seventh, and an eighth decoder, each of said first and second decoders having output terminals serially numbered from one to said first predetermined number, each of said fifth and sixth decoders having output terminals serially numbered from one to said second predetermined number, each of said third, fourth, seventh, and eighth decoders having serially numbered output terminals, each of said first through eighth decoders being responsive to decoder input signals representative of sequentially varying numbers starting with zero for producing decoder output signals from the output terminals having numbers equal to said sequentially varying numbers plus one, respectively, said target arrangement still further comprising means for supplying the count signals as said decoder input signals from said first through eighth pulse counters to said first through eighth decoders, respectively, and means for supplying said decoder output signals as said energizing signals from the serially numbered output terminals of said first through eighth decoders to those photoelectric conversion elements of said first through eighth groups, respectively, which are numbered according to the serial numbers as counted from said predetermined point.

5. A target arrangement as claimed in claim 4, wherein said simulator unit further comprises a center pulse counter responsive to said center output pulses for counting said center output pulses to produce a memory pulse when the count of said center output pulses reaches a predetermined number not greater than said predetermined pulse number and not less than each of said first and second predetermined numbers, and said first and second means comprise a first and a second memory responsive to said memory pulse for memorizing said first and second difference signals and means for supplying the memorized first and second difference signals to said indicator as said first and second input signals, respectively.

* * * * *